United States Patent [19]

Chakrabarti

[11] 4,121,009

[45] Oct. 17, 1978

[54] ANTI-STATIC FABRIC SOFTENING COMPOSITIONS AND PROCESSES FOR DRYING AND SOFTENING TEXTILES THEREWITH

[75] Inventor: Paritosh Mohan Chakrabarti, Wayne, N.J.

[73] Assignee: GAF Corporation, New York, N.Y.

[21] Appl. No.: 723,199

[22] Filed: Sep. 14, 1976

Related U.S. Application Data

[63] Continuation-in-part of Ser. No. 502,638, Sep. 3, 1974, abandoned.

[51] Int. Cl.[2] ..... D06M 13/34

[52] U.S. Cl. ..... 428/260; 252/8.8; 252/357; 260/404.5; 427/11; 427/242; 427/394; 428/290

[58] Field of Search ..... 427/242, 394, 425; 252/8.8, 357, 51.5, 51.5 A; 428/260

[56] References Cited

U.S. PATENT DOCUMENTS

| | | | |
|---|---|---|---|
| 2,528,378 | 10/1950 | Mannheimer et al. | 260/309.6 |
| 2,877,178 | 3/1959 | Bergman et al. | 252/8.8 |
| 3,507,690 | 4/1970 | Walker | 427/242 |
| 3,650,816 | 3/1972 | Rudy et al. | 428/279 |
| 3,686,025 | 8/1972 | Morton | 252/8.8 |
| 3,696,034 | 10/1972 | Hewitt et al. | 252/8.8 |
| 3,749,674 | 7/1973 | Jones et al. | 252/8.8 |
| 3,749,691 | 7/1973 | Kandathil | 252/8.8 X |
| 3,895,128 | 7/1975 | Gaiser | 428/279 |
| 3,897,349 | 7/1975 | Marin et al. | 252/51.5 R |
| 4,012,326 | 3/1977 | Rudy et al. | 252/8.8 |

OTHER PUBLICATIONS

American Perfumes & Aromatics Documentary Edition, #1 -2/17/1960, Mannheimer.

Miranol Amphoteric Surfactants, Publication-The Miranol Chem. Co., Inc., 1960; *Soap and Chem. Specialties,* Jun. 1960.

*Primary Examiner*—Edward M. Woodberry

*Attorney, Agent, or Firm*—Walter C. Kehm

[57] ABSTRACT

Improved anti-static fabric softening compositions, that are obtainable from certain amphoteric surface active agents, are especially useful in processes for household clothes' drying without adversely affecting the rewetting or soil-release properties of the softened fabric.

30 Claims, No Drawings

ANTI-STATIC FABRIC SOFTENING COMPOSITIONS AND PROCESSES FOR DRYING AND SOFTENING TEXTILES THEREWITH

CROSS-REFERENCE TO RELATED APPLICATIONS

This is a continuation-in-part of Ser. No. 502,638, filed Sept. 3, 1974 and now abandoned.

BACKGROUND OF THE INVENTION

1. Field of the Invention

This invention relates to the production of novel anti-static fabric softeners or softening compositions derived from certain select amphoteric surface active agents and processes for their use. The novel anti-static fabric softeners or softening compositions of this invention are especially useful in imparting excellent softening and static elimination of the dried clothes without the adversities of common fabric softeners. The quality of softness or being soft is well defined in the art and, as used herein, means that quality of a treated fabric whereby its texture is smooth, pliable, and fluffy, and not rough or scratchy to the touch. The term "harshness" is defined as the converse or opposite of "softness." Modern heavy duty laundry detergents generally turn fabrics "harsh" particularly after a few launderings. This is partly because such laundering operations usually remove the soft oily "finish" from the fabric and partly because they cause deposition of scratchy inorganic salts such as Ca/Mg carbonates, phosphates, etc. on the fabric. To restore the pliable soft touch to the fabrics, the so-called "fabric softeners" have been incorporated into the laundering operation.

There is still another, and even more notorious problem that is faced in ordinary laundering operations. This is called "static cling" of the dried fabrics and is particularly a problem with modern synthetic fabrics. Static cling is, generally, the phenomenon of one fabric adhering to another or to parts of itself or to the walls of the dryer as a result of static electrical charges located on the surface of the fabric. It can also involve the adherence of lint, dust, and other similarly undesired substances to a fabric, owing to these static charges. It is noticeably present in fabrics that are freshly washed and dried in an automatic dryer. However, softening and reducing the static cling of fabrics makes such fabrics more comfortable when worn and easier to iron since they develop fewer wrinkles, which wrinkles are hard to iron. With larger and larger quantities of synthetic fabrics in the daily laundry load, static cling has become of late a big nuisance, since it seriously interferes with the manageability of the dry clothes and their wearing comfort. Although static is not a new problem with textiles, it did not assume much importance prior to the introduction of hydrophobic fibers. The hygroscopic nature of hydrophilic fiber furnishes sufficient moisture to conduct away any electrical charge generated. The low vapor absorbency of hydrophobic fibers and finishes, however, does not produce electrical conductors with which to disperse static.

In principle, coating a "harsh" fabric surface with "fatty" or "oily" material to impart sufficient lubrication should render it soft to touch. But large quantities of such material are generally required to impart such effect, and such large quantities generally mask the natural feel of the fiber and give it an undesirable "greasy soft," rather than an agreeable "fluffy soft," feel.

DESCRIPTION OF THE PRIOR ART

The fabric softeners or softening compositions generally used by housewives are cationic surface active agents, containing a long hydrophobic tail attached to a quaternary ammonium moiety. It is known that the surfaces of most materials are so charged electrically that cationic surface active materials are electrostatically deposited thereon in oriented molecular arrangement, such as to provide a new surface which is a monolayer of the adsorbed cationic agent. This molecular film is strongly held against dissolution in water, even though the quaternary may be soluble in water. This happens because the adsorbed monolayer is so oriented that its hydrophobic tails are projected outward and the solubilizing hydrophylic end is oriented toward the fiber surface, thus being hidden from outside.

Because the cationic surfactants orient in a monolayer on the fabric, they are effective softeners at low concentrations. However, there are various disadvantages associated with their use as softeners. Some of such disadvantages are that:

(a) the cationic fabric softeners are in general incompatible with anionic detergents and, as such, generally have to be added into the last rinse water in the washing cycles of fabrics, which causes many inconveniences. For example, housewives very often forget to add the softening agent during the rinse cycle of the washing process, thereby necessitating repeated rinse cycles until the softener is remembered and then added;

(b) they are generally accumulative in nature, and so their repeated use leads to considerable buildup; and that (c) they render the fabric hydrophobic, thus drastically reducing soil-release by the fabric in subsequent launderings. It is to be noted that hydrophobic fabrics are prone to easy soiling, particularly by oily soils, and are not as comfortable to wear as hydrophilic fabrics.

Recently the disadvantage (a) referred to above has been largely eliminated by using such cationic-based softeners in the dryer, rather than in the washer. In such applications, the softener is generally either sprayed from an aerosol can (Cling Free) inside the dryer before the wet clothes are put in or it is first impregnated on an absorbent substrate, which is tossed into the dryer along with the wet clothes. In either case, the softener is deposited according to the same mechanism of electrostatic attraction and by physical contact due to tumbling of the clothes.

Fabric softeners are not limited to cationic surfactants alone. Anionic surfactants such as soap also have long been known to be softeners in the wash cycle. The mechanism, here, is that the Ca/Mg salts of soap or acid soaps generally deposit a lubricating coating on the fabric. Other highly hydrophobic anionic surfactants also work by similar mechanism of adsorption in the fabric surface by dint of their shear hydrophobicity. Such materials have been described in U.S. Pat. No. 3,649,569. The same patent also discloses other highly hydrophobic surfactants such as nonionics, amphoterics, amine oxides, etc. to be useful as wash-cycle fabric softeners. However, the softening capacity of such materials is much inferior to those of the cationics.

Both cationics and the effective softeners of the prior art render the softened fabric hydrophobic and are accumulative and as such suffer from the disadvantages (b) and (c) mentioned above.

The cationics, however, have one extra advantage over the other types. They render the fabric static-free. This occurs because the cationic internal layer offers an electrical conductor beneath the hydrophobic monolayer. The anionics do not offer this advantage to any great extent since the anionic charges are generally neutralized by adsorption of polyvalent metal ions, particularly $Ca^{++}/Mg^{++}$. The nonionics are not good static eliminators.

The softening compositions of the present invention, however, are unique in the sense that they are not only free from all the disadvantages mentioned above; but, on the other hand, they also add many extra desirable qualities to the fabric surface. The surfactants of the present invention are of special types which combine in their structure a hydrophobic moiety, an acid group, a basic group and the correct or proper amount of hydrophilicity. The acid and basic groups are so balanced that under proper pH use, they are slightly cationic in nature and exhibit some adsorption characteristics of the latter group. The built-in hydrophilicity helps to render even hydrophobic fiber surfaces as hydrophylic as cotton and thus increases their wearing comfort considerably. The hydrophylicity of the fabric surface further helps in releasing dirt and soil more effectively from the fabric surface. The present softening compositions also impart excellent antistatic properties to the dried clothes, and in this respect they are far superior to the cationics; the surfactants of the present composition impart hydrophilicity and an ionic structure on the fabric surface and both these facts help to conduct away static electricity charges.

With respect to published prior art that is of general pertinence to the present fabric softeners, there may be mentioned U.S. Pat. No. 2,877,178 which broadly covers a plethora of compounds some of which are broadly structurally related to those disclosed and claimed herein in the instant fabric softening compositions, but this patent deals essentially only with compositions derived from amino secondary amides and not with amphoterics derived from amino tertiary amides, or methods of preparation thereof, from which latter subject matter (dealing with amino tertiary amides) are derived the fabric softeners and fabric softening compositions of the present invention, let alone the specific members and embodiments thereof and their use in processes of fabric softening and drying.

The current compositions, on a weight by weight basis, are more efficient anti-static-softeners than those described in the prior art. The surfactants of the present invention, though exhibiting excellent antistatic-softening properties when applied in the dryer according to the current invention, achieve poorer results when used in the rinse cycle. These unexpectedly good results that are achieved in the dryer but not in the rinse cycle can perhaps be theorized on the ground that the built-in hydrophilicity prevents efficient exhausting of the surfactants from solution to the fabric surface. This same property, along with the fact that the surfactants of the current composition do not readily interact with Ca/Mg, helps prevent undue accumulation of the surfactants on the fabric surface on repeated washing. The current composition is thus free from adversities associated with excessive accumulation. Such adversities are: a) gradual yellowing; b) lack of soil release; c) reduction of flame retardance in case of flame retardant fabrics, etc.

SUMMARY OF THE INVENTION

The novel anti-static fabric softeners or softening compositions of this invention comprise generally amphoteric surface active compounds consisting of the following compounds:

(1) N-acyl,N-(2-hydroxyethyl)-N'-carboxymethyl ethylenediamines of the formula:

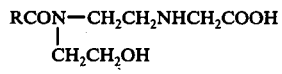

wherein R is an aliphatic group containing 11–21, and preferably 17–21, carbon atoms, and/or admixtures thereof with (2) N-acyl,N'-(2-hydroxyethyl)-N'-carboxymethyl ethylenediamines of the formula:

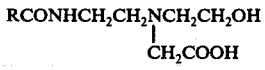

wherein R is an aliphatic group containing 11–21, and preferably 17–21, carbon atoms, and/or (3) a 1-(2-hydroxyethyl)-1-carboxymethyl-2-alkyl imidazolinium hydroxide of the formula,

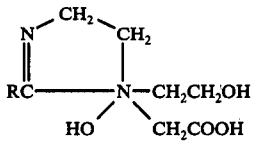

wherein R is an aliphatic group containing 11–21 carbon atoms and preferably 17–21 carbon atoms. Such softeners or softening compositions, moreover, can be applied in a plurality of different ways and in a plurality of different forms such as, e.g., aerosol or pump-spray anti-static softening compositions, applying such compositions as a spray; or in the form of absorbent substrates such as absorbent paper, woven cloth, or nonwoven cloth to which has been applied (via, e.g., coating or impregnation) the aforesaid anti-static fabric softeners or softening compositions. As will be discussed below, the present softeners or softening compositions can be applied in a great variety of ways and forms.

The present invention also relates to a method or process for softening fabrics and imparting anti-static qualities to them by treating such fabrics (e.g., via aerosol or pump spray, or contact with a softener-containing absorbent substrate) with an anti-static fabric softener or softening composition of this invention.

DESCRIPTION OF THE PREFERRED EMBODIMENTS

The present anti-static fabric softeners or softening compositions of this invention comprise, as noted, amphoteric surface active compounds consisting of the following type compounds:

(1) N-acyl,N-(2-hydroxyethyl)-N'-carboxymethyl ethylenediamines of the formula:

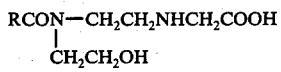

wherein R is an aliphatic group containing 11–21, and preferably 17–21, carbon atoms, and/or admixtures thereof with (2) one or more N-acyl,N'-(2-hydroxyethyl)-N'-carboxymethyl ethylenediamines of the formula:

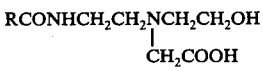

wherein R is an aliphatic group containing 11–21, and preferably 17–21, carbon atoms, and/or (3) one or more 1-(2-hydroxyethyl)-1-carboxymethyl-2-alkyl imidazolinium hydroxides of the formula:

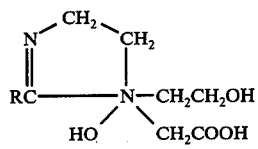

wherein R is an aliphatic group containing 11–21, and preferably 17–21, carbon atoms.

The amphoteric surface active compounds of classes (2) and (3) above are known compositions of matter, and both they and their methods of preparation or production are described in U.S. Pat. Nos. 2,528,378; 2,961,451; and 2,970,160, whose disclosure in both these regards is hereby incorporated herein by reference.

Moreover, the amphoteric surface active compounds of class (1) above are compositions whose nature, identity, and methods of preparation or production are described in U.S. Pat. No. 3,941,817, whose disclosure in these regards is hereby incorporated herein by reference to the extent it does not appear below. As described in said U.S. Pat. 3,941,817, the amphoteric surface active compounds therein; which are inclusive of those of class (1) herein, are derived from novel tertiary amides that, in turn, are derived by condensation of esters of fatty acids with aminoalkyl alkanolamines. Such tertiary amides can generally be characterized by the formula:

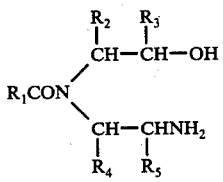

wherein: (a) $R_1$ is an unsubstituted or substituted hydrocarbon radical having from five to twenty-nine carbon atoms, which, when it contains, on the average, of from 11 to 21 carbon atoms, defines the moiety R of this invention and which, as $R_1$ or R when substituted, cntains such typical substituents as Cl; Br; OH; or OAlkyl such as $OCH_3$; and (b) $R_2$, $R_3$, $R_4$, and $R_5$ are each hydrogen or unsubstituted or substituted aliphatic hydrocarbon radicals having from one to four carbon atoms which, when substituted, have the same substituents as defined in $R_1$ or R above.

The production of amphoteric surfactants by reacting fatty amides of hydroxy diamines such as aminoalkyl alkanolamines with monohalocarboxylic acids is disclosed, for example, in U.S. Pat. Nos. 2,961,451 and 2,970,160. However, the amides there disclosed are secondary amides as are those typically prepared by condensation of a fatty acid with an aminoalkyl alkanolamine, such as is disclosed in U.S. Pat. No. 2,344,260. This latter reaction is normally carried out in the range of 130° C. to 200° C. and, even after a prolonged period of heating, gives conversions only of about 60% to 75%, unlike the reactions that are described below, wherein conversions of 90% or higher are achieved.

The amphoteric surface active agents that are employed in the novel fabric softening compositions or formulations of this invention are derived, as noted, from the tertiary amides disclosed and claimed in U.S. Pat. No. 3,941,817 by condensation of such tertiary (mono)amides with a suitable carboxymethylating agent such as a monohalocarboxylic acid or a suitable salt thereof.

The formation of the tertiary monoamide is preferably effected by reacting an aminoalkyl alkanolamine, a preferred aminoalkyl alkanolamine being N-2-hydroxyethyl ethylenediamine, hereinbefore or hereinafter referred to as "aminoethyl ethanolamine," with a fatty acid ester in the presence of a basic catalyst such as an alkali metal or an alkaline earth metal, or a hydroxide or alkoxide thereof, at temperatures in the range of 60° C. to 120° C., preferably 80° C.–100° C. It is to be noted that pressure in itself is not a critical parameter and that, under the preferred temperature range, the final product is essentially a tertiary amide. The reaction to form the desired tertiary amide is generally complete in less than 30 minutes.

While the reaction could be carried out at higher temperatures than those indicated above, it must be carefully recognized that, under such conditions, the reaction would have to be arrested as soon as the tertiary amide was formed so as to prevent its rearrangement to the secondary amide, a result normally obtained under such conditions either during prolonged heating, or at higher temperatures.

The reaction, particularly between the fatty acid esters and the aminoalkyl alkanolamines, under base catalysis, takes place rapidly, as well as at low temperatures, and frequently requires only a few minutes for completion. Preferably, this reaction is thermodynamically and kinetically controlled by conventional means well known to those skilled in the art.

Generally, the reaction time ranges between five minutes and one hour, and conversion is greater than 90%.

As indicated above, the esters of the fatty acids are preferred, in particular, for purposes of this invention, esters such as those of lauric ($C_{12}$-), myristic ($C_{14}$-), palmitic ($C_{16}$-), stearic ($C_{18}$-), arachidic ($C_{20}$-), and behenic ($C_{22}$-) acids. These esters may also be present in the form of mixtures, particularly those derived from natural fats and oils. In general, for commercial practice, it is recognized that surfactants are not generally available in suitable supply in the pure state but rather in the form, almost always, of mixtures.

As indicated above, the fatty acid moiety is supplied as an ester and particularly as an ester of a lower $C_1$–$C_6$ monoalkanol, such as methyl alcohol, ethyl alcohol, tertiary butyl alcohol, or an alkane polyol such as glycerol, and the like. Fatty acid triglycerides, particularly those which are natural fats and oils, are particularly suitable. Such triglycerides can be of vegetable origin, such as coconut oil, linseed oil, olive oil, palm oil, peanut oil, tung oil, rapeseed oil, or they can be of animal or marine origin, such as lard, tallow, sardine oil, etc. The natural fats and oils, above described, can be used as such, or they can be hardened by hydrogenation before use. Generally, when the ester is that of a monoalkanol it is customary to remove the alcohol formed during the condensation by distillation, if necessary, under reduced pressure during the course of the reaction. Where, however, the ester is a triglyceride, the glycerol formed can be allowed to remain in the reaction product, owing to its high boiling point. Preferred aminoalkyl alkanolamines which are suitable for reaction to form the tertiary amide compounds of the structural formula last appearing above are those of the formula:

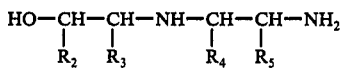

wherein:

$R_2$ - $R_5$ are either hydrogen or an unsubstituted or substituted aliphatic hydrocarbon radical having from one to four carbon atoms, which, when substituted, preferably contains inert substituents such as lower alkyl or alkoxy, etc.; or other inert substituents such as Cl, Br, OH, etc. The preferred aminoalkyl alkanolamine is, as previously noted, aminoethyl ethanolamine.

Basic catalysts which are useful in the present tertiary amide precursor formation are the alkali metals, e.g., sodium, potassium, lithium, etc.; the corresponding alkali metal hydroxides or alkaline earth hydroxides; alkali metal alkoxides; and quaternary ammonium hydroxides. The preferred basic catalysts are sodium methoxide and trimethylbenzyl ammonium hydroxide.

The thus-formed tertiary monoamides can be recovered, but preferably they are not recovered, so that the reaction product can be directly carboxyalkylated by conventional means including reaction, for example, with a monohalocarboxylic acid or salt thereof - such as

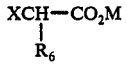

where X is halo (e.g., Cl or Br), $R_6$ is H or $C_1$-$C_4$ alkyl, and M is H, an alkali metal, or ammonium — $ClCH_2CO_2H$ or $ClCH_2CO_2Na$, for example, either in the presence or absence of base. The preferred conditions of this carboxyalkylation reaction are shown, e.g., in U.S. Pat. Nos. 2,961,451 and 2,970,160, whose disclosure in this regard is hereby incorporated herein by reference.

The products of carboxymethylation have been found to be improved amphoteric surface active compositions of the general formula:

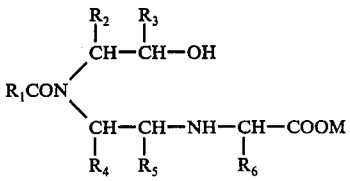

wherein $R_1$ is a substituted or unsubstituted $C_5$-$C_{29}$ hydrocarbon radical (preferably a substituted or unsubstituted $C_{11}$-$C_{21}$ hydrocarbon radical, i.e., R, for fabric softening purposes in accordance with this invention); $R_2$-$R_5$ are H, or substituted or unsubstituted $C_1$-$C_4$ radicals; $R_1$, R, and $R_2$-$R_5$, when substituted contain such substituents as Cl, Br, OH, $OCH_3$, etc., $R_6$ is either H or a lower ($C_1$-$C_4$) alkyl group; and M is either H, or a metal atom such as an alkali metal, or ammonium. The radical $R_1CO$ may be derived from hydrogenated tallow.

Such improved amphoteric surface active compositions wherein $R_1$ of the acyl moiety is $C_{11}$-$C_{21}$, i.e., when this moiety is R, have been found, upon formulation in accordance with the methods or techniques described below, to result in very effective fabric softening compositions, especially when utilized in household clothes drying, such that the rewetting or soil-release properties of the softened fabric are not adversely affected.

Any compound or mixture of compounds from class (1) of the above three (3) classes, or admixture of class (1) compounds with class (2) and/or class (3) compounds comprise the aforementioned amphoteric surface active compounds of the present invention (the term "mixture" being intended to cover several compounds of the same class or of different classes); such compounds, and preferably the compounds of class (1) or admixtures thereof, can be incorporated, as the active component, into the softeners or softening compositions of this invention. Such softeners or softening compositions, as previously noted, can be incorporated, in one embodiment of this invention, via coating or impregnation, into an absorbent material which is also referred to herein as a substrate. Other conventional modes or methods of incorporation of the present fabric softeners or softening compositions are also of utility in the practice of the present invention and include dispensation of the present fabric softeners or softening compositions in the following illustrative, representative (not intended to be exhaustive) forms:impregnation or dissolving paper; impregnated plastic foams of various types of plastic; an encapsulated powder; a wafer, tablet, or pill; as a spray or powder (e.g., as is done with deodorizers for garbage compactors); as replaceable softener impregnated adhesive strips; or in the form of a hollow spherical (or other shape) dispenser with a porous exterior surface for repeated usage in a conventional commercial or household dryer.

Also deemed to be included in the scope of the present invention are any and all mechanical means of utilizing a softener in a dryer which employ the present fabric softener or softening composition.

Preferably, the absorbent substrate is cellulosic, such as paper or cloth. The term "cloth" herein means a woven or nonwoven fabric used as a substrate, in order to distinguish said component from the term "fabric," which is intended herein to mean the textile fabric which is desired to be softened. The amount of softener or softening composition used to give the results required approximates about 10% to 1000% by weight of the dry substrate.

The softening compositions herein, while of some utility when used to soften fabrics in rinse water, such as in the rinse cycle of a standard automatic clothes washer, nevertheless are of much greater utility and find particular application in effectively softening fabrics in a standard, automatic clothes dryer. For such use, the softening composition comprises a softening agent impregnated into a substrate such as paper or nonwoven cellulose cloth that can be made up into a tubular roll or into the form of individual sheets. A desired length of the treated paper is torn off or a sheet removed from its package and placed into the clothes dryer wherein the fabrics to be treated have been loaded. The dryer is then operated in customary fashion and softening and imparting of antistatic properties occur as the fabrics directly contact the treated substrate, whereby the softening agent is transferred from the absorbent substrate to the fabric. The necessary contact between the fabric and the softener-impregnated substrate is effected by the spinning or tumbling action of a standard automatic clothes dryer.

Alternatively, the present softeners or softening compositions can be employed in the form of a solution in suitable solvents either in the form of aerosol sprays, by incorporation into a conventional sealed container under pressure containing a propellant and ejecting means, or in the form of pump sprays, by incorporation into a closed container equipped with a conventional pump valve assembly for ejection as a fine spray.

The mode of action of softeners in a dryer is different from that in a washer. As such the criteria for a good softener for in-washer use (rinse cycle) are not necessarily the same as those for in-dryer use. An ideal softener, irrespective of whether it is applied from the dryer or in a washer, should have the following performance characteristics.

1. It should soften the fabric without creating a greasy feel or limpness.
2. It should eliminate static electricity.
3. It should not build-up on the fabric upon repeated use.
4. It should not reduce the absorptivity (wettability) of the fabric.
5. It should not cause discoloration and/or yellowing of the fabric upon repeated use.
6. It should not make the fabric more prone to soil pickup.
7. It should not make the fabric less prone to soil release.
8. It should not cause spotting or staining in the fabric.
9. It should not cause skin irritation.

In addition, a dryer-type softener should not cause harm to the dryer; namely

10. It should not corrode the dryer drums or lead to rusting of and/or paint peeling from the dryer drums.
11. It should not act as a hot-melt adhesive and cause the softener substrate to stick to the dryer exhaust; for if this happens, the air-flow would be reduced, thereby loading to inefficient drying and possible fire hazard.
12. It should not cause any lint problems; and if the softener is used as a coating on a disposable substrate, the substrate should not break or disintegrate into smaller pieces which could be difficult to trace in the dryer load.
13. It should not adversely effect the dryer in any other way such as by causing malfunction of the electronic shut-off control.

The preferred fabric softeners of the current invention, viz. class (1) compounds, when impregnated on a substrate, are ideally suited for in-dryer use since, when applied from a dryer, they give all the desirable attributes (1) through (9) of an ideal softener as well as the desirable attributes (10) through (13) for safety in the dryer.

The advantages of the amphoteric compounds encompassed by the class (1), (2) and (3) compounds as in-dryer softeners over the conventional cationics or over the commercial softeners are that they do not build up on the fabric, they do not reduce wettability of the fabric, they do not make the fabric more prone to soil pickup and they do not make the fabric less prone to soil release. Conventional non-cationic softeners, such as those mentioned, e.g., in U.S. Pat. Nos. 3,895,128 and 3,686,025 either do not eliminate static electricity or do not give adequate softening.

Though the classes designated by (1), (2), and (3) are preferred over commercial cationic softeners or over other in-dryer softener compositions of the prior art in view of the advantages stated above, for in-dryer application class (1) is the best of classes (1)–(3) since, unlike the other two classes or other prior art in-dryer softener compositions, it has the following added benefits. It is safe for dryer usage (attributes 11 through 12); it does not cause spotting on fabrics; and it is very mild to the skin.

For use as an aerosol or a pump spray, the softener should be used in conjunction with a thinning agent, i.e., either as a clear solution or as a thin emulsion. In general, the thinning agents used should be such that the softener is chemically stable in them and should also be of low boiling point so that no residue is left on the fabric from the thinning agent(s) used. Common thinning agents preferred for this purpose include low boiling materials whose boiling point approximates 100° C. such as water; acetone; petroleum distillates; lower alcohols such as methanol, ethanol, isopropanol, etc.; low-boiling chlorinated solvents such as chloroform, methylene chloride, perchloroethylene; etc. The thinning agents can be used either alone or as admixtures.

As to the construction of the conventional aerosol or pump-spray dispenser utilized, this does not relate to the essence of this invention and therefore reference as to such subject matter can be had from standard works or references in this art.

The basic difference between an aerosol and a pump spray is that the former utilizes a pressurized sealed container from which the liquid is dispensed through a special actuator/valve assembly under pressure whereas the latter is unpressurized and operates on conventional principles of hydraulic pressure applicable to a pump dispensing a liquid through an orifice in the form of a spray.

Aerosols are pressurized by incorporating therein a gaseous component generally known as a propellant. The various desirable properties of a propellant can be obtained from any standard textbook on aerosols. The common aerosol propellants are gaseous hydrocarbons such as isobutane, mixed halogenated hydrocarbons such as trichloromonofluoromethane ($CCl_3F$), dichlorodifluoromethane ($CCl_2F_2$), dichlorotetrafluoroethane ($CClF_2CClF_2$), which are also known as Freon-11, Freon-12, and Freon-114, respectively.

With respect to the present aerosol compositions or formulations, it would be apparent to those skilled in the art that such could include the use of $CO_2$ systems in addition to the Freon type of propellant that is customarily utilized. However, while hydrocarbon propellants in and of themselves would not be desirable, owing to their flammability and the requisite involvement of a pilot light in gas dryers, nevertheless, such hydrocarbons, if combined with other non-flammable propellants such as Freon, $CO_2$, etc., could accordingly be susceptible to use under such circumstances. In addition, non-flammable solvents, such as chlorinated solvents, could also be utilized.

When employed in the form of either an aerosol or pump spray, the softening compositions are sprayed in the dryer prior to the inclusion therein of the fabrics to be treated.

With respect to the use of the absorbent substrate, the following must be pointed out. The preferred substrates of this invention contain some "free space." Free space, also called "void volume," as used herein, is intended to mean that space within a structure that is unoccupied. For example, certain multi-ply paper structures comprise plies embossed with protuberances, the ends of which are mated and joined, and this paper structure has a void volume or free space between the unembossed portions of the plies, as well as between the fibers of the paper sheet itself. A non-woven cloth also has such space between each of its fibers. The free space of non-woven cloth or paper, having designated physical dimensions, can be varied by modifying the density of the fibers of the paper or non-woven cloth. Substrates with a high amount of free space generally have low fiber density; high density substrates generally have a low amount of free space. The substrates of the invention herein have from about 10% to about 90%, preferably about 50%, free space based on the overall volume of the substrate's structure.

Suitable materials which can be used as a substrate in this invention herein include, among others, sponges, paper, and woven and non-woven cloth, all having the necessary free-space requirements defined above. The preferred substrates of the softening compositions herein are cellulosic, particularly multi-ply paper and non-woven cloth.

Specifically, the preferred paper substrate is a compressible, laminated, calendered, multi-ply, absorbent paper structure. Preferably, the paper structure has 2 or 3 plies and a total basis weight of from 10 to 90 pounds per 3,000 square feet. Each ply of the preferred paper structure has a basis weight of about 5 to 30 pounds, per 3,000 square feet, and the paper structure can consist of plies having the same or different basis weights. Each ply is preferably made from a creped, or otherwise extensible, paper with a creped percentage of about 15% to 40% and a machine direction (MD) tensile and cross-machine direction (CMD) tensile of from about 100 to 1,500 grams per square inch of paper width. The two outer plies of a 3-ply paper structure, or each ply of a 2-ply paper structure, are embossed with identical repeating patterns consisting of about 16 to 200 discrete protuberances per square inch, raised to a height of from about 0.010 inch to 0.40 inch above the surface of the unembossed paper sheet. From about 10% to 60% of the paper sheet surface is raised. The distal ends (i.e., the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CMD values of from about 10 to 130.

Suitable adhesives are known in the art and commonly include, among others, water, starches, wet-strength resins, and polyvinyl acetates. A particularly suitable adhesive is prepared by heating from about 2 to about 4 parts by weight of substantially completely hydrolyzed polyvinyl alcohol resin in from about 96 to about 98 parts by weight of water. Preferably, about 0.03 pound of adhesive solids are used to join 3,000 square feet of the embossed plies, with the adhesive being applied to the distal surfaces of the protuberances of one or all plies.

The compressive modulus values which define the compressive deformation characteristics of a paper structure compressively loaded on its opposing surfaces, the HOM values which refer to the stiffness or handle of a paper structure, the MD and HOM values which refer to HOM values obtained from paper structure samples tested in a machine and cross-machine direction, the methods of determining these values, the equipment used, and a more detailed disclosure of the paper structure preferred herein, as well as methods of its preparation, can be found in Edward R. Wells, U.S. Pat. No. 3,414,459, which issued Dec. 3, 1968, the full disclosure of which is hereby incorporated hereinto.

The preferred non-woven cloth substrates useable in the invention herein can generally be defined as adhesively bonded fibrous or filamentous products, having a web or carded fiber structure (where the fiber strength is suitable to allow carding) or comprising fibrous mats, in which the fibers or filaments are distributed haphazardly or in random array (i.e., an array of fibers in a carded web wherein partial orientation of the fibers is frequently present as well as a completely haphazard distributional orientation), or substantially aligned. The fibers or filaments can be natural (e.g., wool, silk, jute, hemp, cotton, linen, sisal, or ramie) or synthetic (e.g., rayon, cellulose ester, polyvinyl derivatives, poly-olefins, polyamides, or polyesters).

Methods of making non-woven cloths are not a part of this invention and, being well known in the art, are not described in detail herein. Generally, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the non-woven cloth. Non-woven cloths made of polyesters, polyamides, vinyl resins, and other thermoplastic fibers can be spun-bonded, i.e., the fibers are spun out onto a flat surface and bonded (melted) together by heat or by chemical reactions.

The choice of binder-resins used in the manufacture of non-woven cloths can provide substrates possessing a variety of desirable traits. For example, the absorbent capacity of the cloth can be increased, decreased, or regulated by respectively using a hydrophilic binder-resin, a hydrophobic binder-resin or a mixture thereof in the fiber bonding step. Moreover, the hydrophobic binder-resin, when used singly or as the predominant compound of a hydrophic-hydrophilic mixture, provides non-woven cloths which are especially useful as substrates when the softening compositions herein are used in the rinse cycle of an automatic washer.

When the substrate of the softening compositions herein is a non-woven cloth made from fibers deposited haphazardly or in random array on the screen, the compositions exhibit excellent strength in all directions and are not prone to tear or separate when used in the washer or the dryer.

Preferably, the non-woven cloth is water-laid or air-laid and is made from cellulosic fibers, particularly from regenerated cellulose or rayon, which fibers are lubricated with a standard textile lubricant. Preferably, the fibers are from 3/16 to 2 inches in length and are from 1.5 to 5 denier.

Preferably, the fibers are at least partially oriented haphazardly, particularly substantially haphazardly, and are adhesively bonded together with hydrophobic or substantially hydrophobic binder-resin, particularly with nonionic self-crosslinking acrylic polymer or polymers. Preferably, the cloth comprises about 70% fiber and 30% binder-resin polymer by weight and has a gross weight of from about 20 to 24 grams per square yard.

The absorbent substrates, which are used in the softening compositions herein, can take a variety of forms. For example, the substrate can be in the shape of a ball or puff, or it may be a sheet or swatch of woven or non-woven cloth. When the substrate is paper or cloth, individual sheets of desired length and width can be used, or, if paper, a continuous roll of desired width from which a measured length is torn off can be employed.

Other additives can also be used in combination with a softening agent. Although not essential to the invention herein, certain of these additives are particularly desirable and useful, e.g., perfumes and brightening agents are also useful.

While not essential, liquids which serve as a carrier for the softening agent can be employed in all of its dispensable forms. Such liquid aid in releasing the softening agent from the absorbent substrate and in promoting adherence of the softener to the fabric contacting the softener-impregnated substrate. Further, the liquid carrier can be used to more evently impregnate the absorbent substrate with the softening agent. When a liquid carrier is so used, it should preferably be inert or stable to the fabric softener. Moreover, the liquid carrier should be substantially evaporated at room temperatures, and the residue (i.e., the softening agent) should then be sufficiently hardened so as not to run or drip off the substrate or cause the substrate to stick together when folded. Isopropyl alcohol or isopropyl alcohol/-water mixtures are the preferred liquid carriers for these purposes; however, methanol, ethanol, or acetone can also be used.

Other additives can include finishing agents, fumigants, fungicides, and sizing agents. Specific examples of possible additives disclosed herein can be found in any current Year Book of the American Association of Textile Chemists and Colorists. Any additive used should be compatible with the softening agent.

The amounts of many additives (e.g., pefume and brighteners) that can be used, for purposes of the present invention in its various types of dispensable forms, in combination with a softening agent, are generally small, being in the range of from 0.01% to 3% by weight of the softening agent.

The softening compositions herein comprise, in one embodiment, the softening agent or agents described hereinbefore, impregnated into an absorbent substrate. The impregnation can be done in any convenient manner, and many methods are known in the art. For example, the softener, in liquid form, can be padded or sprayed onto a substrate or be added to a wood-pulp slurry, from which the substrate is manufactured.

Impregnation, or coating, the substrate with a softener is essential. The term "coating" connotes the adjoining of one substance to the surface of another; "impregnation" is intended to mean the permeation of the entire substrate structure, internally as well as externally. One factor affecting a given substrate's absorbent capacity is its free space. Accordingly, when a softening agent is applied to an absorbent substrate, it penetrates into the free space; hence, the substrate is deemed impregnated. The free space in a substance of low absorbency, such as a one-ply kraft or bond paper, is very limited; such a substrate is, therefore, termed "dense." Thus, while a small portion of the softening agent penetrates into the limited free space available in a dense substrate, a rather substantial balance of the softener does not penetrate and remains on the surface of the substrate so that it is deemed a coating.

In a preferred method of making the softener-impregnated absorbent substrate, the softener is applied to absorbent paper or non-woven cloth by a method generally known as padding. The softening agent is preferably applied in liquid form to the substrate; thus, softeners which are normally solid at room temperature should first be melted and/or solvent-treated with one of the liquid carriers mentioned hereinbefore. Methods of melting the softeners and/or of treating the softener with a solvent are known and can easily be done to provide a satisfactory softener treated substrate.

In another method of impregnation, the softening agent, in liquid form, is sprayed onto absorbent paper as it unrolls and the excess softener is then squeezed off by the use of squeeze rollers or by a doctor-knife. Other variations include the use of metal "nip" rollers onto the leading or entering surfaces of which the softening agent is sprayed; this variation allows the absorbent paper to be treated, usually on one side only just prior to passing between the rollers wherein excess softener is squeezed off; this variation additionally involves the use of metal rollers which can be heated to maintain the softener in the liquid phase. A further method is that of separately treating a desired number of the individual plies of a multi-ply paper and subsequently adhesively joining the plies with a known adhesive-joinder compound; this provides a composition which can be untreated on one of its outer sides yet contains several other plies, each of which is treated on both sides.

In applying the softening agent to the absorbent substrate, the amount of softener impregnated into the absorbent substrate is in the ratio range of 10:1 to 1:2 by weight of the dry untreated substrate. Preferably, the amount of the softening agent impregnated is from about 2:1 to about 1:2, particularly 1:1, by weight of the dry untreated substrate.

The invention can be further illustrated by the following representative, non-limiting examples wherein are described how some of the compounds within the scope of the present invention can be made and used.

EXAMPLE 1

This example illustrates preparation of a surfactant solution which is particularly useful for the present invention. The surfactant of this example is a mixture of structures (1), (2) and (3), described above, wherein the

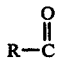

group is derived from a C-18 fatty acid ester (described below).

| Materials | |
|---|---|
| 295 | g P & G Methyl ester CE 18/95 (MW 295) |
| 107 | g Aminoethyl ethanolamine |
| 5 | g 25% Sodium methoxide in methanol |
| 96 | g Chloroacetic acid |
| 120 | g 50% Sodium hydroxide solution |
| 42 | g 37% Hydrochloric acid |
| | Isopropanol |
| | Methylene chloride |

CE 18/95 is a proprietary product of Proctor & Gamble having the following tabulated composition:

| Composition | (Gas-Liquid Chromatography, %) Typical | Limit |
|---|---|---|
| $C_{12}$ | 0.4 | 1.0 max. |
| $C_{14}$ | 0.4 | 0.5 max. |
| $C_{16}$ | 3.2 | 5.0 max. |
| $C_{18}$ | 27 | |
| $C_{18}(1=)$ | 58 | 95 min. |
| $C_{18}(2=)$ | 11 | |
| Saponification Value | 190 | |
| Acid Value | 0.6 | 2.0 max. |
| Iodine Value | 70.0 | |
| Unsaponifiable (%) | 0.4 | 0.5 max. |
| Moisture (%) | 0.03 | 0.05 max. |
| Average Molecular Weight | 295 | |
| Physical Properties | | |
| Specific Gravity 25/25° C. | 0.872 | |
| Melting Point, ° C | 24 | |
| Refractive Index ( ) | $(n_D^{30})1.4471$ | |
| % Transmission (460 mμ) | 60 | 50 min. |

Procedure

Part a.

295.0 g P&G's methyl ester CE 18/95, as described above,
107.0 g Aminoethyl ethanolamine, and
5.0 g 25% methanolic sodium methoxide. The heterogeneous liquid mixture was gradually heated under 150 mm vacuum, the flask being connected with the vacuum aspirator through a dry-ice trap. A narrow stream of nitrogen was allowed to trickle in through the flask. When the temperature went up to 60–70° C., methanol was rapidly given off and the heterogeneous mixture quickly became a clear single phase solution. The temperature was raised to 100–105° C. and held there at 150 mm vacuum for 15 minutes.

About 37 g. of liquid, mostly methanol, was collected in the dry ice trap. The liquid in the flask was allowed to cool to 50° C. The reaction product was a slightly yellow transparent gel at room temperature.

The I.R. spectrum of a sample indicated that the material at this stage is a mixture of the following compounds, with structure (4) making the major contribution.

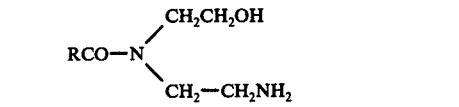

(4)

$RCONH-CH_2-CH_2NHCH_2CH_2OH$, and (5)

-continued

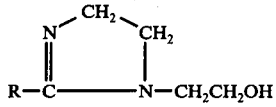

(6)

The I.R. spectrum of a sample of the reaction product indicated the following:

| Absorption (5.5–6.7 micron region only) | Product Indentified |
|---|---|
| 6.15 very strong | tertiary amide plus small amount of secondary amide |
| 6.45 very weak | secondary amide |

The major absorption of 6.15 microns is due to C=O stretching in the tertiary amide, while the very weak 6.45 micron absorption indicates the presence of a small quantity of secondary amide in the structure. N-$C_{18}$ acyl, N-(2-aminoethyl) ethanolamine is, therefore, the major product to the above reaction.

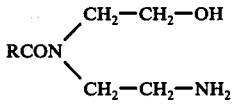

wherein R is a $C_{17}$- radical derived from the CE 18/95 methyl ester, as noted above.

If the above material were to be heated at 100° C. to 105° C. at 150 mm vacuum for another, say, 35 minutes or so, no major change in I.R. spectrum would occur. However, prolonged heating above 120° C. of such material would, as previously indicated, cause slow rearrangement to the stable secondary amide and also simultaneous ring closure to an imidazoline structure.

Part b

While the liquid in the flask was being cooled to 50° C., a solution of sodium chloroacetate in water was prepared as follows:

96 g Chloroacetic acid was dissolved in
375 ml cold water. To this solution was gradually added with cooling and agitation
80 g 50% sodium hydroxide solution, taking care that the temperature remained below 35° C. during the addition. The sodium chloroacetate solution so prepared was added with stirring to the liquid in the flask (part a.) which was cooled beforehand to 50° C. The mixture was heated to 70–80° C. with stirring and held at this temperature range for ½ hour. The pH of the 1% suspension in water at this stage was 6.8. Another
20 g 50% sodium hydroxide solution was added and the heating continued for one hour (pH, 1% aqueous suspension = 7–8). Still another
20 g 50% sodium hydroxide solution was then added and the brown reaction mixture held at 70–80° C. for 1½ hours (pH, as-is 9.9). The mixture was cooled to 40° C.
315 g (=400 ml) Isopropanol was then added and the mixture neutralized with
42 g 37% hydrochloric acid, the acid having been added slowly with cooling such that the temperature remained below 50° C. during the neutralization. The neutralized mixture was then treated by one of the following methods depending upon whether an isopropanol or isopropanol-methylene chloride solution of the product was desired.

Part c. - Isopropanol Solution 720 g (=920 ml) Isopropanol was added to Part b. and the mixture allowed to separate into layers in a separatory funnel. After 15 minutes, the lower aqueous layer (375 g. containing sodium chloride) was taken off and discarded. This isopropanol solution, which was -continued

| Part c. - Isopropanol Solution | |
|---|---|
| 100 g | slightly hazy, was treated with water, whereupon it became crystal clear. |
| Yield | 1720 g. |
| Activity (calc'd): | 25% (1+2+3) |

| Part d. Isopropanol-Methylene chloride solution. | |
|---|---|
| 39 g. | (=50 ml) Isopropanol and |
| 534 g. | (=400 ml) Methylene chloride were added to part b., and the mixture allowed to separate into aqueous and organic phases in a separatory funnel. The lower aqueous phase (375 g) was drawn out from the bottom and discarded. The organic phase weighed 1300 g. Found: 26.7% solids 5.3% water. |

EXAMPLE 2

This example illustrates preparation of an aqueous, isopropanol emulsion of the same type of composition as Example 1 except that bleached tallow was used instead of the CE 18/95 methyl ester. Thus the RC-group in this example has the same alkyl chain distribution as that present in tallow.

Bleached tallow (280 g), aminoethyl ethanolamine (107 g), and 25% methanolic sodium methoxide (5 g) were heated together as in Part a. of Example 1. The condensate so obtained was suspended in a mixture of water (400 g) and isopropanol (100 g) and heated with a solution of sodium chloroacetate (117 g) in water (100 ml). The cloudy emulsion was heated at 50°-70° C. until neutral (4 hrs.). The product was a thick white viscous paste at room temperature.

EXAMPLE 3

This example illustrates synthesis of N-Acyl, N-(2-Hydroxyethyl) N'-Carboxymethyl Ethylenediamine ((1) above), where the acyl group is derived from tallow. The experimental procedure is as follows: Bleached tallow (280 g), aminoethyl ethanolamine (104 g) and 25% methanolic sodium methoxide (5 g) were placed in a 4-neck round-bottom 1-liter flask equipped with a stirrer, a thermometer, a nitrogen inlet and an outlet tube, connected to a vacuum system. A narrow stream of nitrogen was allowed to trickle in through the flask under a vacuum of 150 mm. The flask was heated and the reaction mixture agitated at 100°-105° C. for 1 hour. During this time almost complete conversion of the reaction mixture to N-acyl,N-(2-hydroxyethyl) ethylenediamine

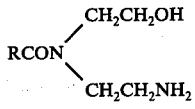

and glycerol occurred where RCO is derived from tallow.

The above aminoamide was suspended in a mixture of water (400 g) and isopropanol (100 g) and treated with a solution of sodium chloroacetate (117 g) in water (100 ml). The cloudy emulsion was heated at 50°-70° C. until neutral (4 hours). The product was a thick white viscous paste at room temperature.

EXAMPLE 4

In this example tallowstearin (hydrogenated tallow) was used, and the acyl group of the resultant amphoteric was thus the same as that found in hydrogenated tallow, i.e., it was a stearoyl group.

The experimental procedure used was as follows:

| | |
|---|---|
| | Charge into a 10 gallon reactor (fitted with condenser) |
| 7435 g. | Hydrogenated tallowstearin |
| 2705 g. | Aminoethyl ethanolamine. |
| | Close reactor and apply 25" vacuum. Heat to 70° C. with agitation. Release vacuum with nitrogen and add |
| 195 g. | Sodium methylate 25% solution in methanol. |
| | Apply 25" vacuum and heat to 100-105° C. Hold at temperature for ¼ hour. Cool to 70° C., release vacuum with nitrogen, and add |
| 2030 g. | Isopropanol. |
| | Agitate 5 minutes, then add with agitation |
| 12350 g. | Deionized water, agitate 5 minutes, and add |
| 1225 g | Chloroacetic Acid, Hazard = 7. |
| | Heat to 55 to 60° C. with agitation. After 30 minutes at 55-60° C. add slowly, maintaining temperature at 55-60° C. |
| 1766 g. | 50% Sodium hydroxide solution. Agitate 1½ hr. at 55-60° C. and add (keeping temperature at 55-60° C.) |
| 1225 g. | Chloroacetic Acid, Agitate again at 55-60° C. for 30 minutes and then add, keeping temperature at 55-60° C., |
| 1665 g. | 50% Sodium hydroxide solution. |
| | Agitate batch at 55-60° C. for 1½ hours. Then add at 55-60° C. |
| 610 g. | Chloroacetic Acid. Heat for 2 hrs. at 55-60° C. |
| | Heat batch to 70° C. and hold at 70-80° C. with agitation for 3 hours. Take sample for pH check (10% suspension in water). Should be 7.2 to 8.0. If outside range, adjust with NaOH or hydrochloric acid. When pH is acceptable, cool to 50° C. and discharge. |
| Yield: | 31,000 g. |

EXAMPLE 5

The secondary amide amphoteric structure of class (2) (RC=derived from stearic) was made by reacting triple pressed stearic acid with aminoethylethanolamine and chloroacetic acid according to the procedure described in Example 1 of U.S. Pat. No. 2,877,178.

EXAMPLE 6

The imidazoline amphoteric structure of class (3) (RC=derived from stearic) was made by reacting 675 g (2.5 moles) triple pressed stearic acid in place of 500 g (2.5 moles) lauric acid with aminoethylethanolamine and chloroacetic acid according to the procedure described in Example 1 of U.S. Pat. No. 3,408,361 of Mannheimer.

EXAMPLE 7

"Bounce" Fabric Softener for dryer, which is described on its commercial label as being:

"a fabric softener (cationic-type), a special softener release agent (nonionic type) in a non-woven rayon", was used as such for comparative studies or it was extracted with water and the aqueous extract was used for the study. It was found that each sheet of Bounce (about 99 sq. inch) had about 4.5 g. of water-extractable chemicals as a coating on non-woven substrate.

EXAMPLE 8

The tertiary amide amphoteric of Example 4 was padded on a light-weight rayon (International Paper Co. — 5008)

| | | |
|---|---|---|
| Basic Weight | ASTM D-1910 | 20 gms/yd$^2$ ± 2.0 gms. |
| Fabric Thickness | ASTM D-1777 | 5 mils ± 0.5 mil |
| Wet Tensile | ASTM D-1682 | MD 60 oz/in, 45 oz min. |

-continued

| | | |
|---|---|---|
| Strength | | CD 8 oz/in, 6 oz min. |
| Air Permeability | ASTM D-737 | 700 CFM, 525 min. |

to give about 2.0 g solids (1.7 g active amphoteric) add-on per 81 square inches of the non-woven substrate. The coated non-woven substrate was then hang-dried overnight.

EXAMPLE 9

Example 8 was repeated except that the tertiary amide amphoteric of Example 4 was replaced by an equal amount of the secondary amide amphoteric of Example 5.

EXAMPLE 10

Example 8 was repeated except that the tertiary amide amphoteric of Example 4 was replaced by an equal amount of the imidazoline amphoteric of Example 6.

EXAMPLE 11

(Comparative)

Example 8 was repeated except that the amphoteric of Example 4 was replaced by 4.5 g dimethyldistearylammonium chloride (VII) per 81 square inch of the non-woven.

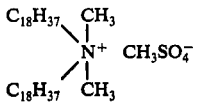

VIII

EXAMPLE 12

(Comparative)

Example 11 was repeated except that the dimethyldistearylammonium chloride was replaced by an equal amount of dimethyl distearylammonium methosulfate (VIII)

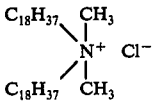

VII

EXAMPLES 13–15

These examples show the superior softening antistatic properties of a spray-type composition of the present invention. An aerosol composition was first prepared as follows:

| | Wt. in g. (as is) | % Composition | |
|---|---|---|---|
| $CH_2Cl_2$-Isopropanol-water sol'n. of amphoteric Surfactant - Example 1 d | 75 | 13.3 | (solids) |
| Water | 3 | 4.7 | |
| Isopropanol | 13.5 | 30.4 | |
| $CH_2Cl_2$ | 13.5 | 21.6 | |
| Freon 12 (propellant)* | 45 | 30.0 | |
| Total | 150 g. | Total 100% | |

*Freon-12 is a registered trademark of duPont for dichlorodifluoromethane($CCl_2F_2$).

The above composition was used to fill a 6 oz. aerosol can of the following description.

| 6 oz. epoxy coated Builders Products can |
|---|
| 0.025 MBRT 015068 66 |
| Stem 2 × 20 Radius Cut 041270 04 |
| Buna N 050310 |
| Body, 020 077730 |
| Dip tube 6 5/16" 092010 |

This experimental spray and a commercial anti-static softener spray were then evaluated in the dryer.

Three six-pound mixed household laundry loads were washed with a leading commercial detergent (Tide) in Sear's Kenmore 700 washer.

The antistatic-fabric softener was sprayed around the inside surface of a Sear's automatic dryer drum for about 5 seconds (about twice around the drum). The can was held in as upright a position as possible and sprayed about 8–10 inches from the drum.

One load of washed wet clothes was placed inside the drum. The dryer was set on regular cycle and shut off automatically when the clothes were dry (40 minutes). Three sets of experiments were performed with the three wash loads, using in one case the experimental spray composition of the present invention, in the second case a leading commercial spray for purposes of comparison, and in the third case no spray at all. Results were as follows:

| Example # | Spray | Static Cling | Softening |
|---|---|---|---|
| 13 | None | Serious static clings | Standard |
| 14 | Experimental Composition of the present invention. | Absolutely no static cling with any item. | Excellent softening. No spotting. |
| 15 | Leading commercial spray. (Cling Free) | Good static elimination in general. Slight static clings with a few items such as ladies' nylon slips, certain polyester items. | Excellent softening with most items -- however lack of uniformity in some cases. |

As can be seen from the above experiments, the fabric softening composition of the present invention gives superior softening and static elimination when used in the dryer as an aerosol spray.

EXAMPLES 16–17

These examples show that the aerosol spray of the present fabric softening composition is superior to "Cling Free" in the sense that its spray button is never clogged and as such never fails to spray. Five cans each of Calgon Corporation's "Cling Free" and of the present experimental spray composition of Example 14 were taken for this experiment. Each can was sprayed for 5 seconds, allowed to stand for 20 minutes (with the cap removed), and sprayed again for 5 seconds. The process was repeated until each can was sprayed 10 times. Whenever clogging of the spray button occurred and the can failed to spray, the button was removed, washed with hot water, and replaced in the can before the next spraying. The number of times the cans failed to spray were noted. Results were as follows:

| Example # | Spray Can Used | Total Number of Sprays | Total Number of Failures* |
|---|---|---|---|
| 16 | Calgon Corporation's Cling Free** | 50 | 7 |
| 17 | Experimental sample of the present invention from Example #14. | 50 | 0 |

*In each case of failure, the button was clogged due to deposition of a waxy material.
**Calgon Corporation's "Cling Free" is a proprietary product containing a conventional solvent and propellant and distearyl dimethyl ammonium quaternary as the active softener ingredient.

EXAMPLES 18–27

These examples show efficiencies of the fabric softening compositions of the present invention in the form of impregnated paper as antistatic softening agents.

Kimwipe disposable tissue (5 × 8 inches) papers were impregnated separately with surfactant compositions of Examples 1c, 2, and 3 by dipping into properly diluted solutions (Example 1c diluted with isopropanol) or properly diluted aqueous suspensions (in the case of Examples 2 and 3) followed by passing through a padding machine so as to give 0.30 g. of the active surfactant add-on per tissue. Other Kimwipe tissues were similarly impregnated with an acetone solution of distearyl dimethyl ammonium chloride so as to give 0.3 g. solid add-on per tissue. The tissues were then hang-dried in the laboratory for 24 hours.

A six-pound mixed household laundry load was washed in a Sears' Kenmore 700 automatic washer with a leading commercial detergent (Tide). The freshly washed clothes were put in a Sears' automatic electric clothes dryer, and the impregnated tissues were tossed into the dryer on the top of the set of clothes. The dryer was started and allowed to run for 40 minutes. After 40 minutes, the dry clothes were taken out and examined for static cling, softness, and local spotting. Results were as follows:

| Example # | Surfactant | No. of Impregnated tissues used/load | Ratings | |
|---|---|---|---|---|
| | | | Static Cling | Softening |
| 18 | None | None | D | Standard-d |
| 19 | Example 1c. | 3 | B | b |
| 20 | Example 1c. | 5 | A | a |
| 21 | Example 2 | 3 | B | b |
| 22 | Example 2 | 5 | A | a |
| 23 | Example 3 | 3 | B | b |
| 24 | Example 3 | 5 | A | a |
| 25 | Distearyl Dimethyl Ammonium Chloride | 5 | C | c |
| 26 | " | 10 | B | b |
| 27 | " | 15 | A | a |

Codes:
Static Cling:
A=No cling at all.
B=Slight clinging, particularly with nylon stockings & ladies' slips.
C=Moderate clinging.
D=Serious clinging.
Softening:
a=excellent.
b=very good.
c=good.
d=standard.

EXAMPLES 28 –52

These examples show that the surfactants of the present invention impart excellent softness and hydrophilicity to fabrics and also improve their soil release properties. The leading surfactant of the prior art, viz., "Cling Free," which contains distearyl dimethyl ammonium quaternary, although it exhibits similar softening properties, does not exhibit the superior rewetting and soil release properties of the materials of the present compositions.

EXAMPLE 28

(softening)

Terry cotton swatches were padded with an approximately 0.6% aqueous solution or suspension of the surfactants to be tested to give about 0.1% active add-on. The swatches were hang-dried for 24 hours and their softness was judged by paired comparison by a panel of 10 judges. Results of such comparison showed that compounds of Examples 1, 2, and 3 and distearyl dimethyl ammonium chloride were all almost equivalent in their softening properties, which, in turn, were much superior to the softness of untreated control swatches.

For determining rewetting properties or hydrophilicity of fabrics treated with the softening agents, the following experiments were carried out. Indian-head cotton, 65:35 dacron/cotton (D/C) with permanent press (PP) finish, and spun dacron swatches (4 × 16 inches) were washed with a standard detergent (Tide). The swatches were then padded respectively with an aqueous suspension of each of the candidates to give 0.1% active add-on, and then hang-dried in the laboratory for 24 hours. Rewetting properties of the swatches were then determined by placing a drop of water thereon and counting the time required for complete disappearance of the drop by absorption on the swatch. Results were as follows:

REWETTING PROPERTIES

| Ex. # | Padded with 0.1% active add-on | Fabric Type | Resulting time in Seconds average 3) |
|---|---|---|---|
| 29 (Control) | None | Indianhead Cotton | 0 |
| 30 (Control) | None | D/C with PP | >250 |
| 31 (Control) | None | Spun Dacron | >250 |
| 32 | Compound of Ex. 1 | Indianhead Cotton | 0 |
| 33 | " | D/C with PP | 5 |
| 34 | " | Spun Dacron | 5 |
| 35 | Compound of Ex. 2 | Indianhead Cotton | 0 |
| 36 | " | D/C with PP | 5 |
| 37 | " | Spun Dacron | 5 |
| 38 | Compound of Ex. 3 | Indianhead Cotton | 0 |
| 39 | " | D/C with PP | 5 |
| 40 | " | Spun Dacron | 5 |
| 41 | Distearyl dimethyl ammonium chloride | Indianhead Cotton | 120 |
| 42 | " | D/C with PP | >250 |
| 43 | " | Spun Dacron | 120 |

The "dacron-cotton (65/35) with permanent press" swatches which were padded as above were also tested for soil release. For this, one set of swatches was stained directly and another set was stained after washing in the terg-o-tometer. Each swatch was stained at different spots with dirty motor oil, Wesson vegetable oil and mineral oil (Nujol) respectively. Five drops of the oil were put at each spot, and the spot then covered with a piece of polyethylene sheet and pressed with a 2 kg. weight evenly placed on the polyethylene sheet for 1 minute. The stained swatches were washed again in the terg-o-tometer, hang-dried for 24 hours and then rated for soil release. The stain release was rated as 4 to 1, 4 being the best release and 1 the worst release with each stain. A score of 4 did not, however, necessarily mean perfect stain release.

| Ex. # | Padded with 0.1% active add-on | Operation[1] | Soil Release Score[2] [3] DMO | VO | MO |
|---|---|---|---|---|---|
| 44 Control | None | W-S-W | Poor | 3 | 2 |
| 45 | Compound of Ex. 1C | W-P-S-W | Poor | 4 | 3 |
| 46 | Compound of Ex. 2 | " | Poor | 4 | 3 |
| 47 | Compound of Ex. 3 | " | Poor | 4 | 2 |
| 48 | Distearyl dimethyl ammonium chloride | " | Poor | 1 | 1 |
| 49 | Compound of Ex. 1c | W-P-W-S-W | Poor | 4 | 3 |
| 50 | Compound of Ex. 2 | " | Poor | 4 | 3 |
| 51 | Compound of Ex. 3 | " | Poor | 4 | 3 |
| 52 | Distearyl dimethyl ammonium chloride | " | Poor | 1 | 1 |

[1]W-Washed, P-Padded, S-Stained
[2]1-worst, 4-best,
[3]DMO-Dirty Motor Oil, VO-Vegetable Oil, MO-Mineral Oil

EXAMPLE 53

Comparable Softening and Static Elimination

Seven sets of six lb. mixed laundry loads were washed in a Sear's Kenmore 700 automatic washer with a loading commercial detergent (Tide). The freshly washed clothes were put in a Sear's Automatic electric clothes dryer and in each of three sets one 81 square inch coated non-woven substrate from Examples 8, 9, 10, 11, 12 or a sheet of Bounce fabric softener was tossed into the dryer on the top of the set of clothes; no softener was used in the 7th set, which acted as a control. The sets were dried for 40 minutes at the end of which they were examined for static cling and softness.

The control set (no softener) showed considerable static cling and the "feel" of the dried clothes was harsher than those of the other three sets. The three sets which used compositions of Examples 8 to 12 or Bounce were all static free and exhibited a desirable soft "feel."

EXAMPLE 54

Rewetting Properties and Spotting

This Example is designed to show that, under high softener to fabric contact conditions in the dryer (temperature 120°-180° F.), the compositions of the current invention should improve rewetting properties of the fabric whereas Bounce will reduce the rewetting properties. It also shows that Bounce may cause spotting.

In this experiment a 2 × 2 inch piece of Bounce and a 2 × 2 inch piece of the softener coated non-woven substrate of Example 8 was placed on a swatch of white light-weight 100% spun dacron fabric and a flat 500 g weight was placed on each of the pieces. These assemblies were then held for 4 hours at 150° F., cooled, and the weight and the softener pieces removed. The Bounce covered area showed a profuse transfer of material which exhibited itself as a wax coated patch or spot. The area coated with softener composition of Example 8 was indistinguishable visually from the uncovered areas, i.e., there was no spot or waxy coating.

The areas so treated with softener pieces and a control site (no softener treatment) of the spun 100% dacron fabric were then tested for wetting properties. The wetting procedure followed was the conventional one described in AATCC method 39-1952, wherein the fabric was held taut over the open end of a beaker by means of a rubber band. A burette was placed over and above the fabric so that the tip of the burette was one centimeter above the fabric surface. A drop of distilled water was released and timed from the point of touching the fabric until the drop no longer reflected light and appeared as a damp spot.

The results of these tests are recorded in the following table.

| Area treated with 100% Spun Dacron (lightweight) | Wetting Time |
|---|---|
| Bounce: | over 300 seconds |
| Softener of Example 8: | less than 5 seconds |
| Untreated Control: | 110 seconds |

Compositions of Examples 11 and 12 behaved similarly to Bounce when subjected to the above conditions whereas compositions of Examples 9 and 10 behaved similarly to that of Example 8.

EXAMPLE 55

Spotting in Dryer

Bounce or Cling-free (sponge), on their respective commercial labels, warn against use thereof in high temperature coin-operated machines, since, the products may cause spotting of the fabric under such conditions.

This Example shows that while Bounce causes spotting on fabric under the above conditions, the composition of Example 8 is free from this drawback.

Wash loads were composed of 4 lbs. of various fabrics. Each load was initially washed in Tide detergent and subsequently with water only. After each wash, the load was dried in a coin-operated dryer (Huebs C-8 Machine Dryer) at the high temperature setting. During the drying cycle, one load was treated with Bounce, the second with one sheet of Example 8 and the third without any softener.

At the end of the 10 cycles the loads were visually inspected for spotting. The Bounce-dried load exhibited abundant yellow spots and the fabrics generally looked dingy or discolored. The load dried with the softener of Example 8 or the control load did not exhibit any sign of spotting and the fabrics exhibited a fresh new look.

EXAMPLE 56

Resoiling

This Example is designed to show that the softeners of Examples 4, 5 and 6 do not, when added on fabric, lead to increased soil pickup tendencies whereas, Downy or conventional cationic fabric softeners such as dimethyl distearyl ammonium chloride do increase the soil pickup tendencies of the fabric.

In this test, the following procedures were carried out:

Fabric samples of, respectively, spun 100% polyester, 50/50 polyester-cotton with durable press finish, and 100% cotton were soaked for 15 minutes at 130° F. in respective solutions of different softeners (identified below), each solution consisting of 10 cc of 1% active softener diluted with 90 cc of water. In addition, a control without softener was also utilized in this test. The softeners used were those of Example 4, Example 5, Example 6, Downy and dimethyl distearyl ammonium chloride.

All of the thus-treated samples were oven dried at 90° F. for ½ hour.

The resoiling test was effected by treating each of the dried samples in a solution of 10 cc of 1% Aquadag (a suspension of graphite in water manufactured by Acheson Colloids Co. of Port Huron, Michigan) and 1000 cc water for 15 minutes at 180° F.

The samples were then rinsed with water and dried.

Visual inspection of the fabrics showed that the control test fabric and the fabrics treated with softeners of Examples 4, 5 and 6 showed some degree of soil pickup whereas the fabrics treated with Downy and with dimethyl distearyl ammonium chloride showed significantly increased soil pickup as shown by the relatively much darker color of the fabrics in the latter cases.

EXAMPLE 57

Resoiling

This test shows that Bounce, when transferred to fabric under dryer application conditions, causes the fabric to very strongly attract soil when compared to the softener of Example 8.

In this test, the following procedures were carried out with swatches of (1) a pink 100% polyester fabric purchased from Cloth World, Wayne, New Jersey, which was identified as Matisse Pink, a 100% polyester double knit "wash 'n wear" fabric; and of (2) a blue 65/35 polyester/cotton blend fabric, which was identified as a 65% polyester, 35% permanent press broadcloth fabric.

Swatches of each of the above-identified fabrics, taken from the 10 cycle drying test in Example 55 above, were placed in 150 cc of distilled water and 4 cc of a 1% solution of Aquadag (a carbon-type soil in water suspension, manufactured by Acheson Colloids Company). The solutions were then heated from 80° F. to 160° F. over a 15 minute period. The swatches were then rinsed in tap water and allowed to air dry.

Visual inspection of the dry swatches showed the Bounce-dried swatches of Example 55 to be significantly darker (more soil pickup) than the swatches of Example 55 which were dried with the softener of Example 8.

EXAMPLES 58–61

Corrosion of Dryer

The corrosion of dryer drums is a serious problem to which each in-dryer type softener should address itself. Since most dryer drums and the other exposed parts inside of the dryers today have epoxy or phenolic coatings over carbon steel, it might appear that corrosion should not be a problem. However, this is not true. In spite of the painted or coated surfaces, the inside of the dryer drums may still pose serious corrosion, rusting and associated paint-peeling problems and significantly reduce the useful life of the dryer.

The rusting, corrosion or paint peeling problems manifest themselves due to the fact that today's wash-loads contain hard metallic parts in the form of chains, zippers, hooks etc. During the tumbling action in the dryers, these metallic parts constantly impact upon the painted surfaces and often cause small pinholes in such surfaces. Thus the inside metallic surfaces get exposed at the sites of such pinholes. Rusting and corrosion may thus start at such pinholes and spread beneath the painted surfaces thus peeling off the paint and exposing more surface to corrosion. Water itself may cause the rusting or corrosion, but if a softener is used inside the dryer, it must be made certain that it does not add to the corrosion problem. The active softener component in the formulation of commercial in-dryer softeners was recently changed from a cationic chloride such as dimethyl distearyl ammonium chloride, to a cationic sulfate such as dimethyl distearyl methosulfate in order to reduce the severe dryer corrosion problems caused by these softeners.

The in-dryer softeners will enhance corrosion problems if (a) they have a tendency to transfer themselves from the vehicle carrying the softener to the dryer surface or to the metallic surface at the pinholes in the dryer surface, and if (b) the softener material is either corrosive in nature, or (c) if it helps to retain water along with it at the points of its residence on the dryer surface.

In the case of (b), the corrosion will increase because the softener is corrosive and in the case of (c) corrosion will increase because the softener increases the residence time for water, which itself can cause rusting, at the points of its contact.

Ideally, therefore, an in-dryer softener should, in addition to performing its basic function as a softener, (i) not transfer itself to the dryer surface to any significant extent and, if it does, it should (ii) inhibit rusting, and should (iii) not hold water at the points of its residence on the dryer surface.

EXAMPLE 58

This example shows relative transfer tendencies of different softeners from their substrate to the exposed metallic surface of the dryer at drying temperatures (120° F–180° F).

1 × 3 inches pieces of the softener-coated non-woven substrate taken, respectively, from Examples 8, 9 and 10 and a similar piece of Bounce were each placed between two 1 × 3 inches (0.031 inch thickness) C-1010 cold rolled carbon steel coupons (#4 temper, #2 finish, unground and deburred from the Metaspec Company, San Antonio, Texas). The sandwiches so made, i.e., two carbon steel coupons with the softener in-between, were then laid flat in an oven and held at 150° F. for 20 minutes. The sandwiches were then taken out and cooled to room temperature. The sandwiches were then examined for sticking and transfer of softener chemical to the metal coupons. For each type softener, five sets were used and the number of cases out of these five where sticking and transfer was observed were noted. The results are shown below.

| Softener Composition Used | No. of cases out of 5 that exhibited significant softener sticking and transfer |
|---|---|
| Composition of Example 8 (tertiary amide amphoteric) | None |
| Composition of Example 9 (secondary amide amphoteric) | 5 |
| Composition of Example 10 (Imidazoline amphoteric) | 3 |
| Bounce | 5 |

It may be seen from the above table that the tertiary amide amphoteric of the current invention does not exhibit a tendency to transfer itself to metal surfaces at dryer temperature, whereas the others do.

EXAMPLE 59

Retention of Water on Metal Surface

This example shows the relative tendency of the different softener compositions to hold water on to metal surfaces. The experiment was run as follows.

A solution or suspension of the softeners in distilled water was first made so that each solution contained 1% nonvolatile (solids) in terms of the actual softener candidate. In the case of Bounce, the chemical was extracted with water from the non-woven substrate and then adjusted to 1% solids (non-volatile) level. The softeners used in this experiment were those of Example 4, 5 and 6 and Bounce extract. In 100 ml. size beakers, filled to a depth of about 2 inches with the above softener solutions, 1 × 3 inches carbon steel coupons (for detailed description of coupons see Example 58) were hung half immersed with a thread. After 24 hours, the coupons were lifted and examined for any gel formation on the surface. The coupons were rated from 1 to 5, the ratings representing severity of gel formation as follows.

| Rating | Extent of gel formation |
|---|---|
| 1 | Less than 5% of the immersed surface of the coupon covered with gel. |
| 2 | Between 5 to 25% of the immersed surface is covered with gel. |
| 3 | Between 25 to 50% of the immersed surface is covered with gel. |
| 4 | Between 50 to 75% of the immersed surface is covered with gel. |
| 5 | Between 75 to 100% of the immersed surface is covered with gel. |

The freshly prepared solutions of all the softeners were thin liquids — the formation of gel on the immersed metal coupon surfaces that sticks to the surface when the coupons are raised from the solutions indicates the tendency of the softener chemical to hold water in the form of a gel on the metal surfaces. The different softener solutions showed the following ratings of gel formation in this experiment.

| Softener Composition (1% solids in water) | Gel formation rating |
|---|---|
| Composition of Example 4 (tertiary amide amphoteric) | 1 |
| Composition of Example 5 (secondary amide amphoteric) | 5 |
| Composition of Example 6 (imidazoline amphoteric) | 5 |
| Bounce Extract | 5 |

It is thus clear from this example that the tertiary amide amphoteric is significantly superior to the others in the sense that it does not tend to hold water on the metal surface. Thus, unless the other compositions have anti-rusting properties, their use in the dryer will enhance the corrosion caused by water.

EXAMPLE 60

This example shows inherent rusting or rust inhibitory properties of different fabric softener compositions.

The experiment was similar to that described in Example 59. 1 × 3 inches carbon steel coupons were half immersed into 2 inches deep solutions of "1% as solids" of different fabric softener compositions and left undisturbed for 96 hours. A control experiment, in which distilled water without any softener, and coupon was used, was also run simultaneously. At the end of 96 hours the gels from the coupons, if any, were scraped off and transferred to the respective solutions. The rusting properties of the test solutions were measured in terms of development of dark brown color in the solutions. The colors of the initial solutions and after 96 hours exposure to coupons were measured in a Varnish Color Scale (VCS) measuring instrument. The higher the VCS number, the darker being the color. The difference between the final color and the initial color gave a measure of the rust causing potential of the solutions involved. The results are shown in the following table.

| Softener Composition Used (1% solids in water) | VCS Color Initial (A) | VCS Color Final (B) | Extent of Rusting (B–A) |
|---|---|---|---|
| Composition of Example 4 (tertiary amide amphoteric) | 3 | 3.5 | 0.5 |
| Composition of Example 5 (secondary amide amphoteric) | 3 | 5.0 | 2.0 |
| Composition of Example 6 (Imidazoline amphoteric) | 3.5 | 5.5 | 2.0 |
| Dimethyl distearyl ammonium chloride | 3.0 | 7.0 | 4.0 |
| Dimethyl distearyl ammonium methosulfate | 3.0 | 6.5 | 3.5 |
| Bounce extract | 3.0 | 6.5 | 3.5 |
| Water alone | 0 | 3.5 | 3.5 |

As can be seen from the above table, the composition of Example 4 is outstandingly superior to the others in the sense that it has excellent rust inhibitory properties. Though the others do not apparently contribute to rusting, except possibly for the dimethyldistearyl ammonium chloride, in comparison with water alone they do not have much rust inhibitory effect either. Thus in actual dryer application, the others would give a much higher degree of rusting compared to that of Example 4 since they have a tendency to increase the residence time of water at the point of their contact in the dryer surface (see Example 59) and they do transfer significantly onto the dryer surface (see Example 58). The validity of this conclusion is shown in Example 61.

EXAMPLE 61

This example shows that the cumulative conclusions drawn from Examples 58–60 are valid under simulated use conditions.

An experiment similar to that described in Example 58 was conducted. At the end of 20 minutes in the oven the coupons were cooled and separated from one another and from the softener piece. Two products were used in this experiment — one was that described in Example 8 and the other was Bounce. It was observed that the Bounce coupons had softener chemical transferred to them which appeared as asperity caused by spotted transfer of the softener. The coupons containing the softener piece of Example 8 did not have any asperity or visible transfer of softener chemical.

These coupons, along with a control untreated coupon, were then held at 95–100% relative humidity at 150° F. and observed for appearance of rust on them. The results are shown in the following table.

| Observed at hours in 100% RH/150° F. | Rusting rating on Coupons Treated with Softener of (1) | | |
|---|---|---|---|
| | Example 8 | Control (no softener) | Bounce |
| 18 hours | 1 | 1 | 3 (2) |
| 26 hours | 1 | 1 | 4 (2) |
| 49.5 hours | 1 | 1.5 | 4.5 (2) |
| 96 hours | 1.5 | 2 | 5.0 (2) |

(1) 1 = no visible rusting
5 = severe rusting resulting in pits.
(2) The rusting occurred almost exclusively at the asperities of the transferred softeners.

EXAMPLES 62–63

Sticking to Dryer Vent

The sticking of the softener coated substrate to the dryer vent may cause undesirable effects such as reduced air-flow, culminating in inefficient drying of excessive heat build-up leading to fire hazards. In the case of Bounce, the problem of reduced air-flow was minimized by incorporating slits along the length of the softener substrate. However, incorporation of such slits increases the chance of the substrate breaking off during the drying and making the task of removing torn pieces from the dry load difficult. However, this change was required in Bounce as the previously introduced unslit Bounce gave a problem of sticking to the dryer vent. However, from convenience and aesthetic points of view, the unslit solid softener piece would be more desirable.

The problem of sticking to the dryer vent is a direct result of the softener chemical acting as a hot-melt adhesive between the substrate and the dryer surface. During the drying operation it is quite likely that once in a while the air current will carry the softener piece and put it flat against the dryer vent. If the softener chemical now acts as a hot-melt adhesive, the piece will be held there until sufficient force is applied to remove it from that position. If the force required is too high, the rubbing action of the clothes on the softener piece during tumbling in the dryer may not be sufficient to remove the piece and an impairment of air-flow will result along with its accompanying disadvantages.

EXAMPLE 62

This example compares the hot-melt-adhesive force between the softener of Example 8 and Bounce.

The experiment was similar to that described in Example 58.

1 × 3 inches pieces of Bounce and of composition described in Example 8 were sandwiched between pairs of 1 × 3 inches coupons. The coupons were then placed flat in an oven and held there for 20 minutes at 150° F. The coupons were cooled, and the following forces were measured in an Instron instrument.

(a) The half peel strength. One metal coupon was carefully removed, if necessary with force. The softener was then half peeled and the force required to peel off the remainder was measured on the instron.

(b) The horizontal shear strength between the two coupons in the sandwich was measured. The results are shown in the following table.

| Types of Coupons | Measured forces with Softener composition used | |
|---|---|---|
| | Composition of Example 8 | Bounce |
| | Half Peel Strength | |
| Carbon steel C1010 coupons | 0 | 0.1 lbs. |
| Epoxy coated coupons | 0 | 0.2 lbs. |
| Phenolic coated coupons | 0 | 0.2 lbs. |
| | Horizontal Shear Strength | |
| Carbon steel C1010 coupons | 0 | No reading - sheared in machine |
| Epoxy coated coupons | 0 | 81.5 lbs. |
| Phenolic coated coupons | 0 | 82.5 lbs. |

EXAMPLE 63

In this example solid, unslit Bounce (Bounce samples before Procter & Gamble introduced the slit Bounce) and compositions of Example 8 were used.

A 4-pound laundry load was dried 20 times in a Sear's Kenmore dryer. Each time two pieces of softener composition — one unslit Bounce and the other unslit composition of Example 8 — were used. At the end of each drying cycle the dryer was opened and inspected for the softener piece sticking to the exhaust vent.

In the case of unslit Bounce, two cases of sticking out of 20 runs were observed.

In the case of the softener composition of Example 8, no sticking was observed.

EXAMPLE 64

Skin Irritation

Patch tests on 100 human subjects were carried out by an independent testing laboratory using 1 × 1 inches patches of Bounce and of the composition described in Example 8. The degree of irritation and the number of incidences of each degree of irritation under the patches were recorded. The results are shown in the following table. The irritation scores are shown in a 0 to 4 scale, zero representing no irritation, 1 representing very mild irritation and 4 representing the severest.

| Irritation Level (Lower numbers mean less irritation | Number of Cases Corresponding to Irritation Scores (Total 100 cases) | |
|---|---|---|
| | Bounce | Softener of Example 8 |
| 3+ | 8 | 0 |
| 2+ | 12 | 1 |
| 1+ | 16 | 4 |
| less than 1 | 3 | 3 |
| 0 | 61 | 92 |

The above results shown that the composition of Example 8 is significantly less irritating than Bounce.

Thus, it has been seen that the present invention relates to improved anti-static fabric softeners comprising compounds of the formulae described on pages 8 to 10 above, or mixtures thereof, which have been found to be especially useful in household clothes drying without adversely affecting the rewetting or soil release properties of the softened fabric.

Preferred formulations of the present novel softeners or softener admixtures including optional, additional ingredients can be prepared in accordance with the following examples, Examples 65–74.

EXAMPLE 65

Treat 100 g of the amphoteric composition of Example 4 with 0.1% of an antioxidant consisting of a 50/50 blend of dl alpha tocopherol and BHT (butylated hydroxy toluene - Vanlube PCX from Vanderbilt).

EXAMPLE 66

Treat the amphoteric composition of Example 4 with 2% w/w of Emulphogene © TB970 (a nonionic surfactant from GAF) as a conditioning agent.

EXAMPLE 67

Treat the amphoteric of Example 4 with a 0.1% antioxidant blend of Example 65 and 2% Emulphogene © TB970, and 1% perfume (International Flavors & Fragrances perfume #2272-Z).

EXAMPLE 68

(Softener for Dryer Composition)

Repeat the procedure of Example 8 except for the use of the composition of Example 65 in place of that of Example 4. The performance of this product is equivalent in all respects to that of Example 8 except that it has a better storage stability.

EXAMPLE 69

Repeat the procedure of Example 8 except for the use of the composition of Example 66 in place of that of Example 4. The performance of this product is similar to that of Example 8 except that the Example 66 containing product has a better "hand" than that of Example 8.

EXAMPLE 70

Repeat the procedure of Example 8 except for the use of the composition of Example 67 in place of that of Example 4. The performance of this product is similar to that of Example 8, but, in addition, it has a better "hand" and better storage stability.

EXAMPLE 71

(Softener for Dryer Composition)

Coat the composition of Example 67 on a non-woven rayon substrate to give 1.0 g composition per 100 sq. inches of the non-woven rayon substrate. This composition although predictably somewhat less effective in softening otherwise performs well as an antistatic softener for drying.

EXAMPLE 72

Coat the composition of Example 67 on a non-woven rayon substrate to give 15 g. of the composition/100 sq. inches of the non-woven rayon substrate. This composition is particularly suitable for extraordinarily large dryer loads.

EXAMPLE 73

(Softener for Dryer Composition)

Coat the composition of Example 67 on a polyurethane foam to give 4.5 g of the composition per 3 × 6 × 1/16 inch piece of said foam. The performance of this composition is similar to that of Example 8.

EXAMPLE 74

Variations of the aerosol compositions of Example 14 are set forth as follows:

| | Wt in g (as is) (a) | (b) |
|---|---|---|
| $CH_2Cl_2$-Isopropanol-water | — | 15 g |
| Solution of amphoteric surfactant Example 1d | 2.0 g | |
| Water | 3 g | 3 g |
| Isopropanol | 48.5 g | 43.5 g |
| $CH_2Cl_2$ | 48.5 g | 43.5 g |
| Freon 12 (propellant) | 45 g | 45 g |

Any method of evenly dispensing the composition of the present invention in the dryer would result in an equivalent and effective performance in the dryer.

The composition of Examples 74 (a) and 74 (b) minimized the static electricity of the fabrics when such compositions were used in a dryer as described in Examples 13–15 but the softening of the fabrics was not quite as efficient as that with the composition of Example 14. These aerosol compositions are therefor preferred only in those cases where the user is less interested in softness and wants to minimize static cling in the dryer load.

It is preferred that the fabric softening compositions of this invention comprise an amount of fabric softener of from about 0.5 to about 100% by weight.

When such fabric softening composition is incorporated into an absorbent substrate, such substrate should have from about 10% to about 90% free space, based on the overall volume of the substrate. When incorporated into an aerosol container, the fabric softener should be incorporated therein in an effective amount (about 0.5 to about 50% by weight of the whole composition) together with from about 0 to about 90% by weight of a suitable low-boiling organic solvent having a boiling point of less than about 100° C.; 0 to about 90% by weight of water, and 0 to about 90% by weight of an aerosol propellant.

When used in the form of a pump spray composition, the present fabric softening composition includes an effective amount of the fabric softener, (e.g., 0.5 to about 50% by weight of said composition); about 0 to about 90% by weight of a suitable low-boiling organic solvent having a boiling point of less than 100° C., and 0 to about 90% by weight of water.

A latitude of modification, change, and substitution is intended in the foregoing disclosure, and in some instances some features of the invention will be employed without a corresponding use of other features. Accordingly, it is appropriate that the appended claims be construed broadly and in a manner consistent with the spirit and scope of the invention described herein.

I claim:

1. A fabric softening composition comprising (a) a fabric softener having the formula:

$$\begin{array}{l} RCON-CH_2CH_2NHCH_2COOH \\ \quad\;\; | \\ \quad\;\; CH_2CH_2OH \end{array}$$

wherein R is an unsubstituted or substituted $C_{11}$–$C_{21}$ aliphatic hydrocarbon radical which, when substituted, has at least one substituent selected from the group consisting of Cl, Br, OH, and $OCH_3$ and (b)

an adsorbent substrate having from about 10% to about 90% free space based on the overall volume of the substrate, the fabric softener being incorporated into said substrate.

2. A composition as defined in claim 1 wherein said substrate is fibrous.

3. A composition as defined in claim 2 wherein said substrate is non-woven.

4. A composition as defined in claim 1 wherein said substrate is paper.

5. A composition as defined in claim 1 wherein said substrate is cloth.

6. A fabric softening composition according to claim 1 wherein the amount of the fabric softener incorporated into said substrate ranges from about 10:1 to about 1:2 by weight of the dry untreated substrate.

7. A fabric softening composition according to claim 6 wherein the amount of the fabric softener incorporated into said substrate ranges from about 2:1 to about 1:2 by weight of the dry untreated substrate.

8. A fabric softening composition comprising (a) a fabric softener having the formula:

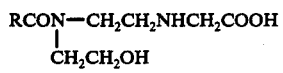

wherein R is an unsubstituted or substituted $C_{11}$–$C_{21}$ aliphatic hydrocarbon radical which, when substituted, has at least one substituent selected from the group consisting of Cl, Br, OH, and $OCH_3$, and being present in an amount of from about 0.5 to about 50% by weight of said composition; (b) a suitable solvent for (a); and (c) an aerosol propellant.

9. A fabric softening composition comprising (a) a fabric softener having the formula

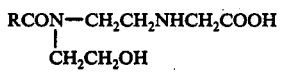

wherein R is an unsubstituted or substituted $C_{11}$–$C_{21}$ aliphatic hydrocarbon radical which, when substituted, has at least one substituent selected from the group consisting of Cl, Br, OH, and $OCH_3$, and being present in an amount of from about 0.5 to about 50% by weight of said composition and (b) a suitable solvent for (a).

10. A fabric softening composition comprising (a) a fabric softener comprising an admixture of amphoteric compound of the formula:

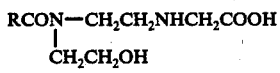

(1)

with at least one of

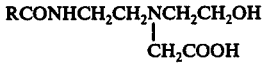

(2)

and

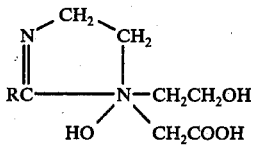

(3)

wherein R is an unsubstituted or substituted $C_{11}$–$C_{21}$ aliphatic hydrocarbon radical which, when substituted, has one or more substituents selected from the group consisting of Cl, Br, OH, and $OCH_3$; and (b) an adsorbent substrate having from about 10% to about 90% free space based on the overall volume of the substrate, said fabric softener being incorporated in the adsorbent substrate.

11. A fabric softening composition according to claim 1 wherein R is an unsubstituted or substituted $C_{17}$–$C_{21}$ aliphatic hydrocarbon radical.

12. A fabric softening composition according to claim 1 wherein the acyl radical R-CO is derived from a $C_{18}$ fatty acid ester.

13. A fabric softening composition according to claim 1 wherein the acyl radical R-CO is derived from a fatty acid triglyceride.

14. A fabric softening composition according to claim 13 wherein said fatty acid triglyceride is bleached or hydrogenated tallow.

15. A fabric softening composition according to claim 10 wherein the acyl radical R-CO is derived from a fatty acid triglyceride.

16. A fabric softening composition according to claim 15 wherein said fatty acid triglyceride is bleached or hydrogenated tallow.

17. A fabric softening system comprising (a) a fabric softener having the formula:

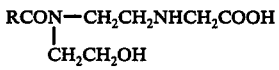

wherein R is an unsubstituted $C_{11}$–$C_{21}$ aliphatic hydrocarbon radical which, when substituted has at least one substituent selected from the group consisting of Cl, Br, OH and $OCH_3$ and (b) dispensing means for dispensing said fabric softener into a dryer.

18. A fabric softening system according to claim 17 wherein R is an unsubstituted or substituted $C_{17}$–$C_{21}$ aliphatic hydrocarbon radical.

19. A fabric softening system according to claim 17 wherein the acyl radical R-CO is derived from a $C_{18}$ fatty acid ester.

20. A fabric softening system according to claim 17 wherein the acyl radical R-CO is derived from a fatty acid triglyceride.

21. A fabric softening system according to claim 20 wherein said fatty acid triglyceride is bleached or hydrogenated tallow.

22. A process of simultaneously drying and softening textile materials in a dryer, comprising the step of contacting said textile materials, under normal drying conditions, with an effective amount of a fabric softening composition as defined in claim 1.

23. A process of simultaneously drying and softening textile materials in a dryer, comprising the step of contacting said textile materials, under normal drying conditions, with an effective amount of a fabric softening composition as defined in claim 8.

24. A process of simultaneously drying and softening textile materials in a dryer, comprising the step of contacting said textile materials, under normal drying conditions, with an effective amount of a fabric softening composition as defined in claim 9.

25. A process of simultaneously drying and softening textile materials in a dryer, comprising the step of contacting said textile materials, under normal drying conditions, with an effective amount of a fabric softening composition as defined in claim 10.

26. A process of simultaneously drying and softening textile materials in a dryer, comprising the step of contacting said textile materials, under normal drying conditions, with an effective amount of a fabric softening composition as defined in claim 14.

27. A process of simultaneously drying and softening textile materials in a dryer, comprising the step of contacting said textile materials, under normal drying conditions, with an effective amount of a fabric softening compositions as defined in claim 16.

28. A process of simultaneously drying and softening textile materials in a dryer, comprising the step of contacting said textile materials under normal drying conditions, with an effective amount of a fabric softener dispensed from a system as defined in claim 17.

29. A process of simultaneously drying and softening textile materials in a dryer, comprising the step of contacting said textile materials, under normal drying conditions, with an effective amount of a fabric softener dispensed from a system as defined in claim 21.

30. A process of simultaneously drying and softening textile materials in a dryer comprising contacting said materials under normal drying conditions with an effective amount of a fabric softening composition containing:

(1) an amphoteric fabric softener compound of the formula:

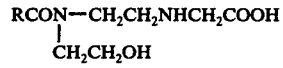

in admixture with at least one of the amphoteric fabric softener compounds of the formula:

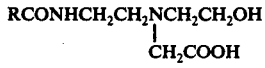

(2)

and

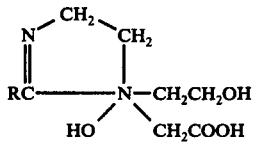

(3)

wherein R is an unsubstituted or substituted $C_{11}$–$C_{21}$ aliphatic hydrocarbon radical which, when substituted, has one or more substituents selected from the group consisting of Cl, Br, OH and $OCH_3$.

* * * * *